US007382331B2

(12) United States Patent
Kurashima et al.

(10) Patent No.: US 7,382,331 B2
(45) Date of Patent: Jun. 3, 2008

(54) ANTENNA DEVICE

(75) Inventors: Shigemi Kurashima, Shinagawa (JP); Masahiro Yanagi, Shinagawa (JP); Hideki Iwata, Shinagawa (JP); Takashi Yuba, Shinagawa (JP); Masahiro Kaneko, Shinagawa (JP); Yuriko Segawa, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/585,902

(22) Filed: Oct. 25, 2006

(65) Prior Publication Data

US 2007/0229363 A1 Oct. 4, 2007

(30) Foreign Application Priority Data

Mar. 29, 2006 (JP) ..... 2006-091605

(51) Int. Cl.

*H01Q 15/08* (2006.01)
*H01Q 1/38* (2006.01)
*H01Q 1/48* (2006.01)

(52) U.S. Cl. ..... 343/911 L; 343/700 MS; 343/846

(58) Field of Classification Search ..... 343/700 MS, 343/753, 840, 911 L, 846, 911 R
See application file for complete search history.

(56) References Cited

U.S. PATENT DOCUMENTS

| | | | | |
|---|---|---|---|---|
| 4,755,820 | A * | 7/1988 | Backhouse et al. .. | 343/700 MS |
| 6,246,369 | B1 * | 6/2001 | Brown et al. ..... | 343/700 MS |
| 6,713,162 | B2 * | 3/2004 | Takaya et al. ..... | 428/209 |
| 6,946,995 | B2 * | 9/2005 | Choi et al. ..... | 343/700 MS |

OTHER PUBLICATIONS

Technical Report: An Omnidirectional and Low VSWR Antenna for the FCC-Approved UWB Frequency Band, written and proposed by Takuya Taniguchi and Takehiko Kobayashi, in The General Conference of The Institute of Electronics, Information and Communication Engineers, in 2003.

* cited by examiner

*Primary Examiner*—Shih-Chao Chen
(74) *Attorney, Agent, or Firm*—Staas & Halsey LLP

(57) ABSTRACT

An antenna device includes an antenna part and a dielectric formed on the antenna part. The dielectric is formed to be thicker in a direction of directivity that the antenna part is to be made to have, than in another direction.

10 Claims, 9 Drawing Sheets

ANTENNA DEVICE

BACKGROUND OF THE INVENTION

1. Field of the Invention

The present invention relates generally to antenna devices, and more particularly to a directional antenna device.

2. Description of the Related Art

In recent years and continuing, wireless communication technology using UWB (ultra-wide band) is attracting attention, as radar positioning is possible and communications of a large transmission capacity can be achieved. In 2002, the FCC (Federal Communication Commission) of the US authorized usage of a frequency band of 3.1 GHz through 10.6 GHz.

UWB is a communication method of communicating pulse signals in an ultra-wide band. Therefore, UWB requires an antenna having a structure with which signals can be transmitted and received in an ultra-wide band.

There is a proposed antenna including a bottom board and a power feeding body, to be used in the frequency band of at least 3.1 GHz through 10.6 GHz, authorized by the FCC (Non-patent literature 1).

Non-patent literature 1: An Omnidirectional and Low-VSWR Antenna for the FCC-Approved UWB Frequency Band, written and proposed by Takuya Taniguchi and Takehiko Kobayashi of Tokyo Denki University, at 2003 IEICE (The Institute of Electronics, Information and Communication Engineers) General Conference, B-1-133, on Mar. 22, 2003, at Tohoku University, Kawauchi Campus, classroom B201

However, this type of UWB antenna is nondirectional, and therefore, communication efficiencies are degraded when directivity is required.

SUMMARY OF THE INVENTION

The present invention provides an antenna device in which one or more of the above-described disadvantages is eliminated.

A preferred embodiment of the present invention provides an antenna device that can improve directivity with a simple structure.

An embodiment of the present invention provides an antenna device including an antenna part; and a dielectric formed on the antenna part; wherein the dielectric is formed to be thicker in a direction of directivity that the antenna part is to be made to have, than in another direction.

An embodiment of the present invention provides a method of manufacturing an antenna device including an antenna part on which a dielectric material is molded, the method including the step of insert-molding the antenna part with the dielectric material, such that the dielectric material is thicker in a direction of directivity that the antenna part is to be made to have, than in another direction.

An embodiment of the present invention provides a method of manufacturing an antenna device including an antenna part and a dielectric formed on the antenna part, the dielectric being formed to be thicker in a direction of directivity that the antenna part is to be made to have, than in another direction, the method including the step of one of attaching the dielectric to the antenna part; and insert-molding the antenna part and the dielectric.

According to one embodiment of the present invention, an antenna device that can improve directivity with a simple structure is provided.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

First Embodiment

Figure 1:
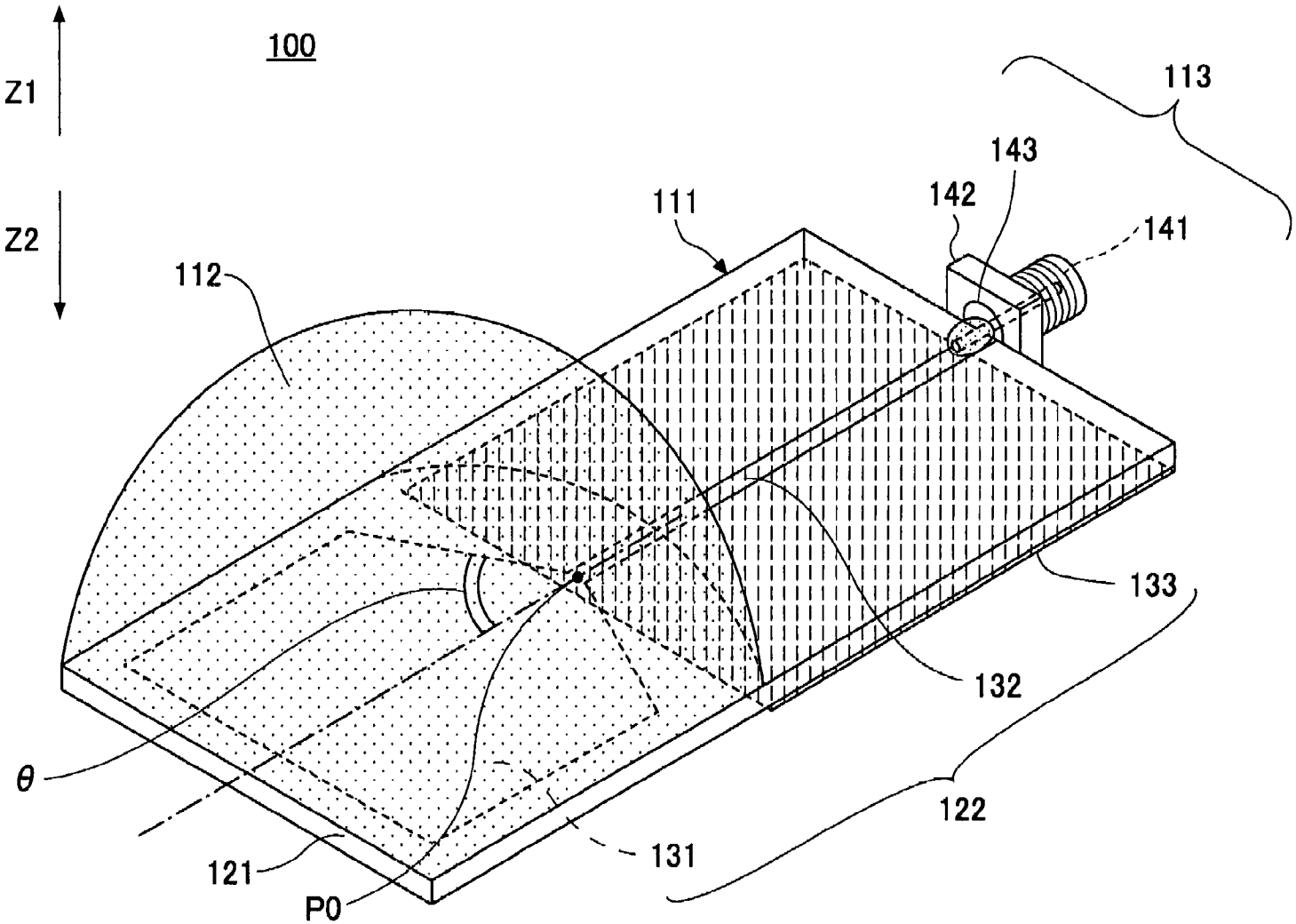
FIG. 1 is a perspective view of an antenna device according to a first embodiment of the present invention.
Figure 2:
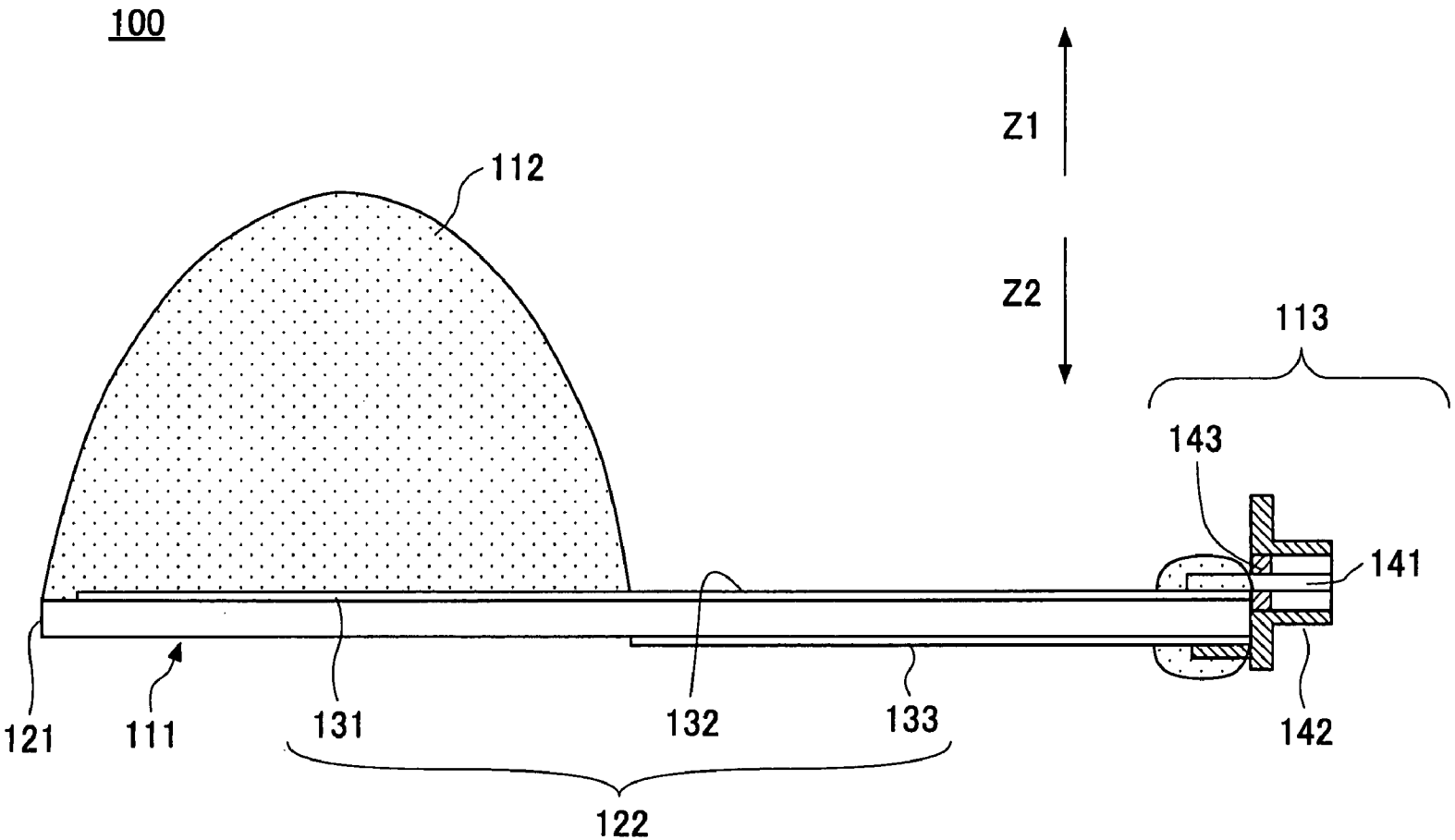
FIG. 2 is a cut-away side view of the antenna device according to the first embodiment of the present invention.

FIG. 1 is a perspective view of a first embodiment according to the present invention, and FIG. 2 is a cut-away side view of the first embodiment.

An antenna device 100 according to the first embodiment is a monopole antenna for UWB communication, and includes an antenna part 111, a dielectric 112, and a connector 113. The antenna part 111 includes a conductive pattern 122 formed on a printed wiring board 121 in a predetermined pattern.

The printed wiring board 121 includes dielectrics such as FR4 and ceramics, and the surface thereof is patterned with the conductive pattern 122 by etching, etc. The conductive pattern 122 includes an element pattern 131, a transmission line 132, and a ground pattern 133.

The element pattern 131 is a substantially rectangular-shaped conductive pattern formed on one side of the printed wiring board 121. A power feeding point P0 is formed on the edge of the element pattern 131 opposing the ground pattern 133. Two sides of the element pattern 131, between which the power feeding point P0 is positioned, are each tilted by an angle θ with respect to an axis orthogonal to the side of the ground pattern 133 opposing the element pattern 131. The angle θ is a predetermined angle of, for example, substantially 63 degrees.

The transmission line 132 is formed on the printed wiring board 121, on the same side as the element pattern 131. One end of the transmission line 132 is connected to the power feeding point P0, and the other end is extended to the edge part of the printed wiring board 121. The transmission line 132 and the ground pattern 133 are opposed to each other with the printed wiring board 121 located therebetween, the transmission line 132 serving as a so-called microstrip line. The ground pattern 133 is formed on the other side of the printed wiring board 121, contacting the power feeding point P0 of the element pattern 131. The element pattern 131 and the ground pattern 133 are opposed to each other with the printed wiring board 121 located therebetween, and are therefore not electrically coupled.

The connector 113 includes a signal pin 141, a sealed member 142, and an insulating member 143. The signal pin 141 is held by the sealed member 142 via the insulating member 143. The signal pin 141 is soldered to the transmission line 132 at the edge part on one side of the printed wiring board 121. The sealed member 142 is soldered to the ground pattern 133 at the edge part on the other side of the printed wiring board 121.

The dielectric 112 is fabricated by molding a dielectric material of relatively high dielectric constant $\in r$ such as ABS or MC nylon, into a substantially conical shape. The dielectric 112 is formed on the element pattern 131 of the antenna part 111, so as to be thicker in a direction indicated by an arrow Z1 (above the element pattern 131), than in a direction indicated by an arrow Z2 (below the element pattern 131). The dielectric 112 can be formed by molding the highly dielectric material into the substantially conical shape, and then attaching the molded cone onto the antenna part 111; or by insert-molding the antenna part 111 with the highly dielectric material.

The directions indicated by the arrows Z1, Z2 are orthogonal to the element pattern 131 of the antenna part 111, i.e., orthogonal to the printed wiring board 121. Further, the two directions indicated by the arrows Z1, Z2 are opposite to each other. It is noted that ABS has a dielectric constant of $\in r$=3 through 7, and MC nylon has a dielectric constant of $\in r$=2.7 through 4.7.

The dielectric 112 has effects on antenna directivity as described below.

Figure 3:
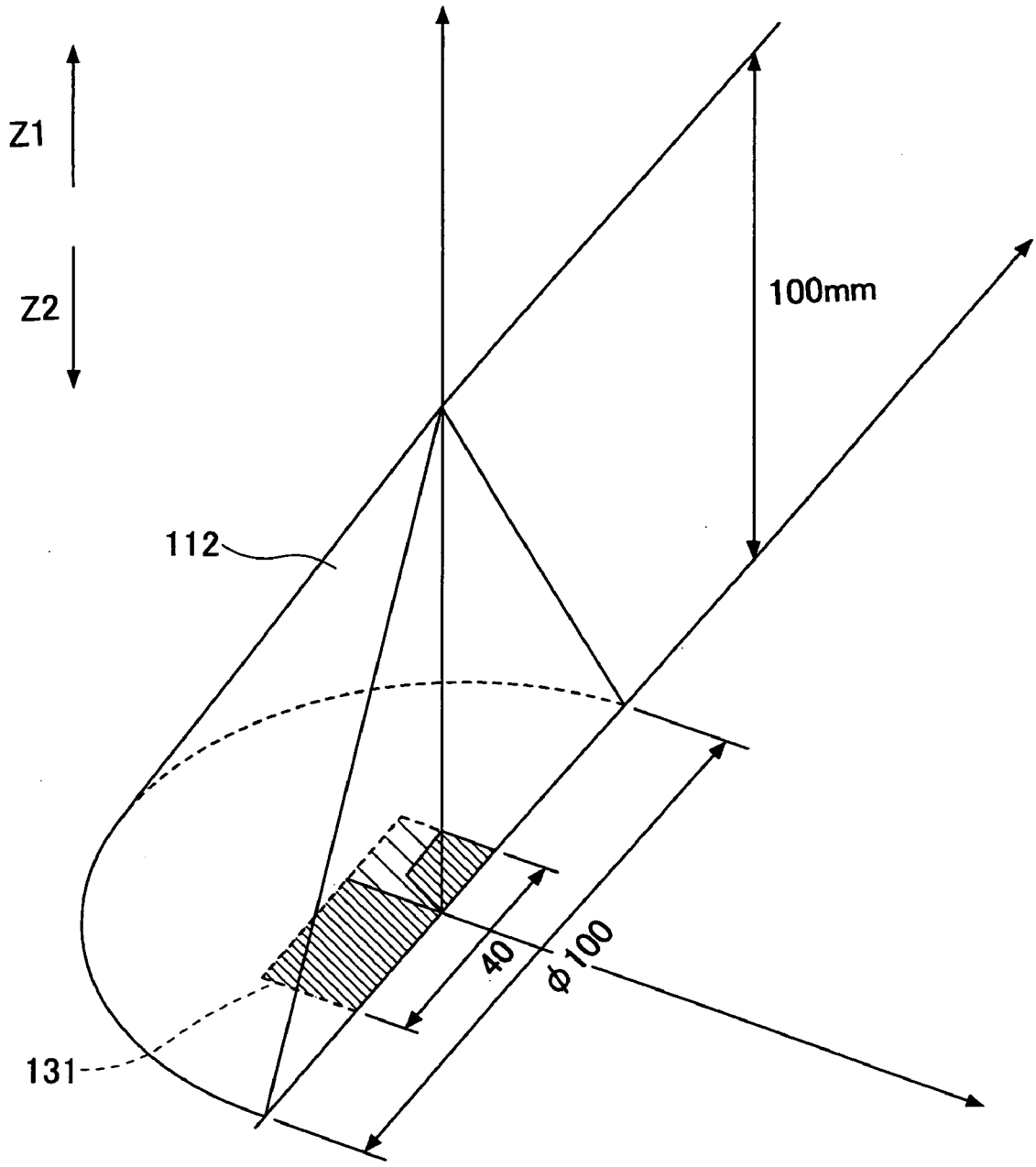
FIG. 3 is a simulation model of the antenna device.
Figure 4:
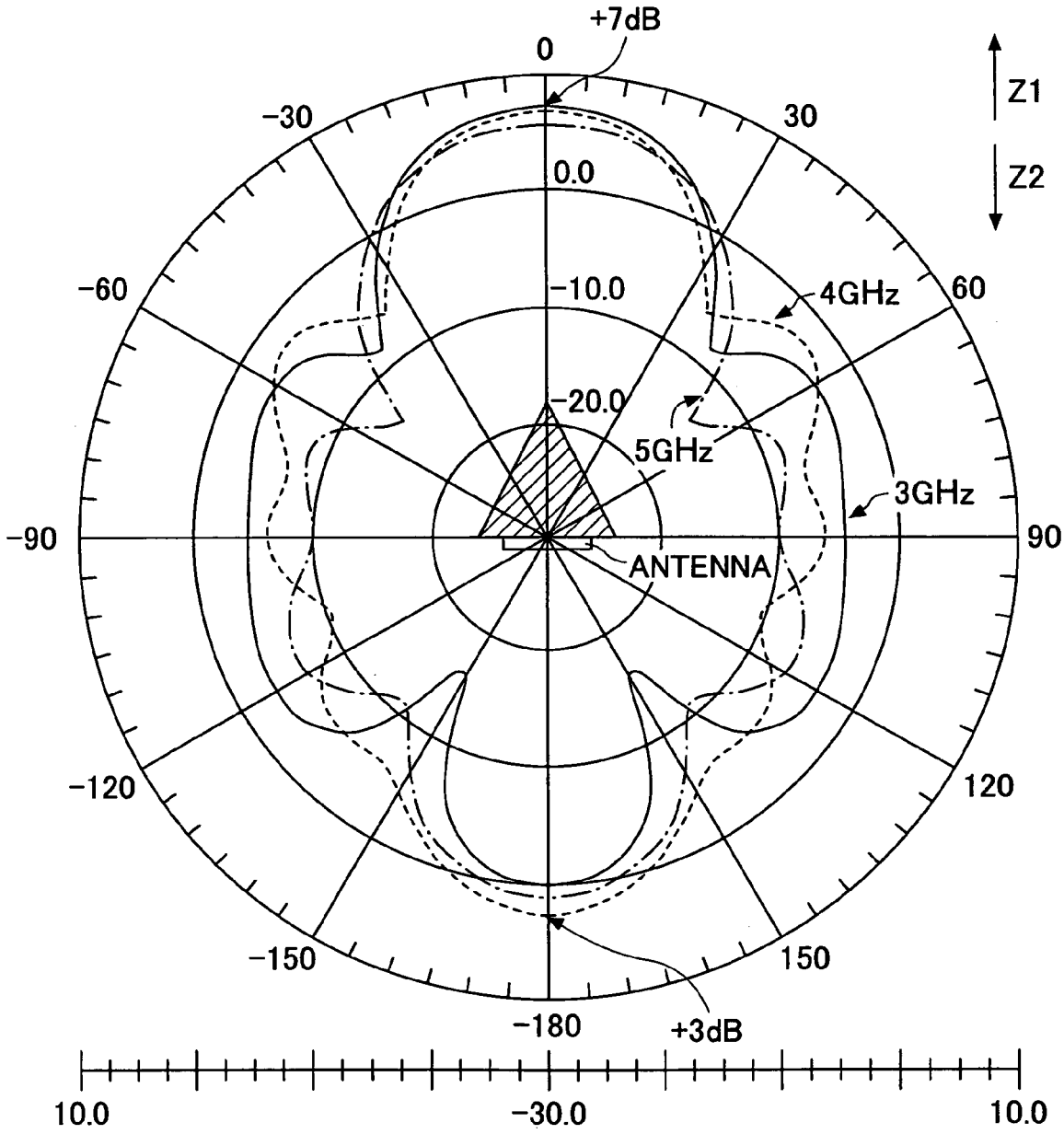
FIG. 4 indicates the directivity of the simulation model.

FIG. 3 is a simulation model of the antenna device 100, and FIG. 4 indicates the directivity of the simulation model. In FIG. 4, the solid line expresses properties of 3 GHz, the dashed line 4 GHz, and the dash-dot line 5 GHz.

In the simulation model, the element pattern 131 is a conductive pattern whose sides are substantially 40 mm. The dielectric 112 is formed into a conical shape having a diameter of substantially 100 mm and a height of substantially 100 mm, in a direction indicated by an arrow Z1 orthogonal to the element pattern 131, centered around the center of the element pattern 131, with a dielectric constant of substantially $\in r$=10.

FIG. 4 indicates simulation results obtained by using the simulation model shown in FIG. 3.

By forming the dielectric 112 in the conical shape on the element pattern 131 in the direction indicated by the arrow Z1 as shown in FIG. 3, the gain in the Z1 direction is substantially +7 dB, whereas the gain in a Z2 direction opposite to the Z1 direction is substantially +3 dB, which is less than half of that of the Z1 direction. As shown in FIG. 4, the gain in the Z1 direction is greater than the gain in the Z2 direction in any of 3 GHz, 4 GHz, and 5 GHz.

Accordingly, it is possible to make the antenna directivity be in the Z1 direction, which is the direction in which the dielectric 112 is formed.

According to the first embodiment, by laminating the dielectric 112 so as to be thicker in a direction of the intended antenna directivity than in another direction, it is possible to make the antenna directivity be in the direction corresponding to the thick part of the dielectric 112. Therefore, directivity can be given to a nondirectional antenna.

The dielectric 112 can be made thinner by increasing the dielectric constant, if the directivity is to be the same.

Second Embodiment

Figure 5:
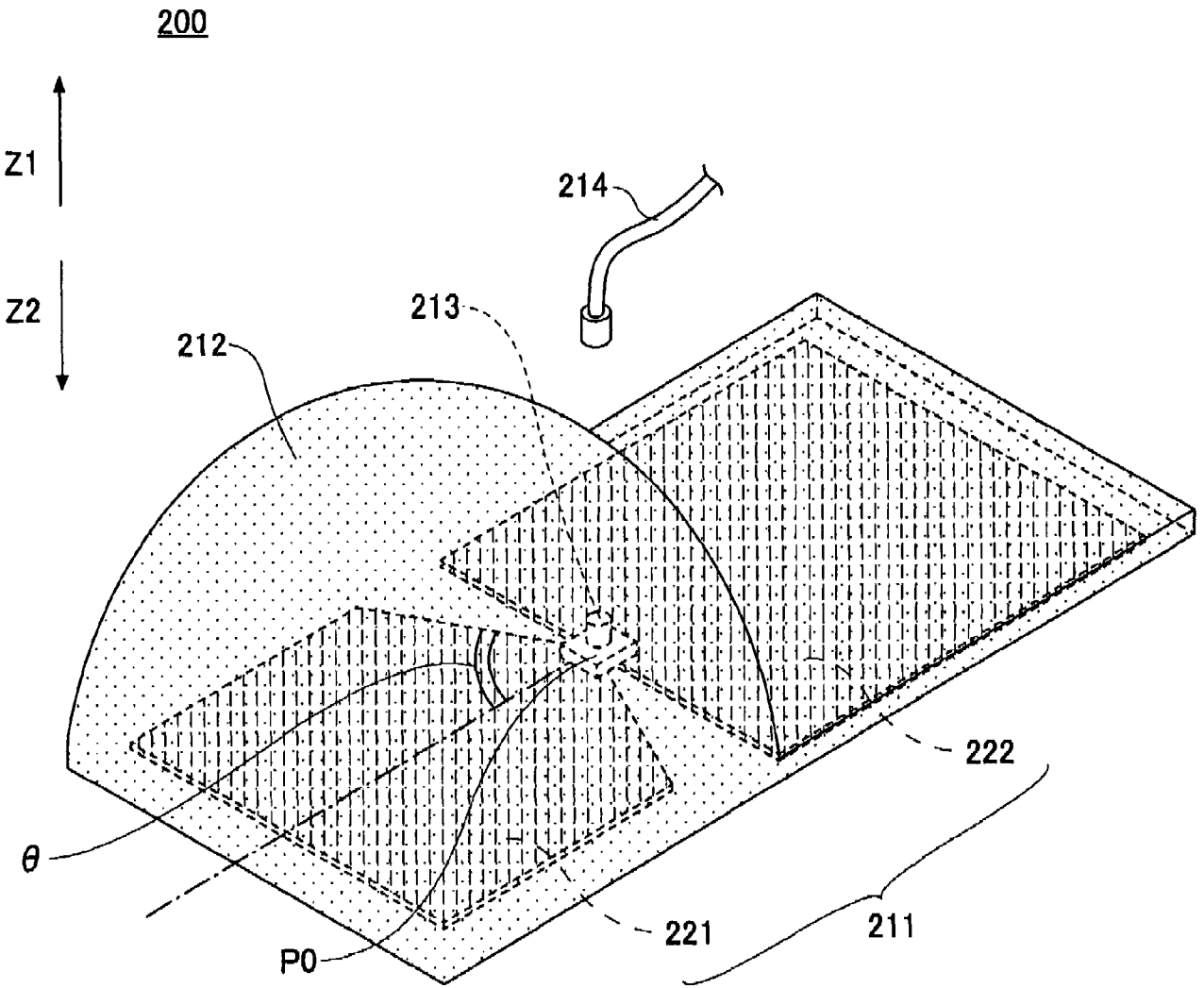
FIG. 5 is a perspective view of an antenna device according to a second embodiment of the present invention.
Figure 6:
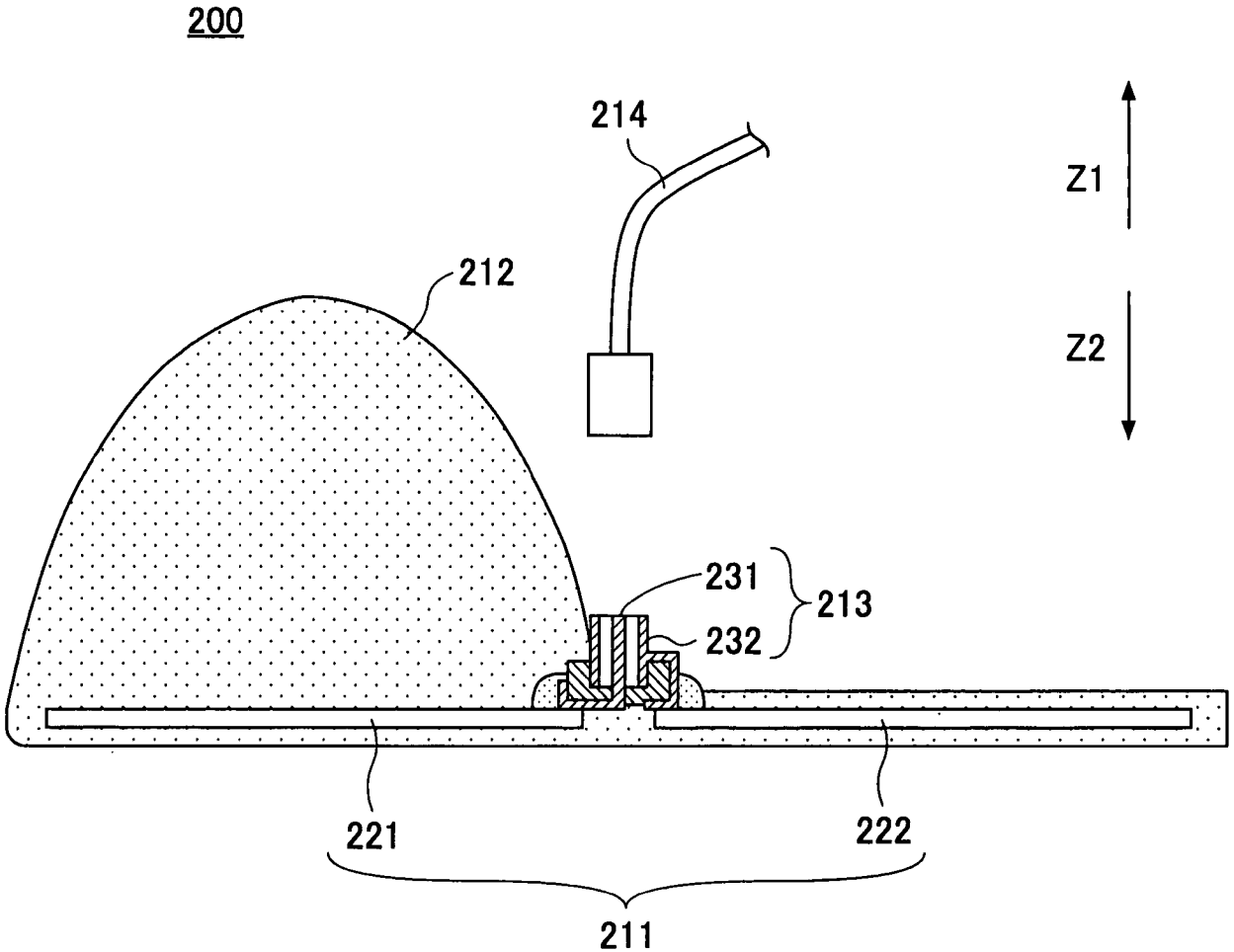
FIG. 6 is a cut-away side view of the antenna device according to the second embodiment of the present invention.

FIG. 5 is a perspective view of a second embodiment according to the present invention, and FIG. 6 is a cut-away side view of the second embodiment.

An antenna device 200 according to the second embodiment is a monopole antenna for UWB communication, similar to the first embodiment, and includes an antenna part 211, a dielectric 212, and a connector 213. The antenna part 211 is formed by punching a sheet metal in press working.

The antenna part 211 includes an element part 221 and a ground part 222.

The element part 221 has a substantially rectangular shape. A power feeding point P0 is formed on the edge of the element part 221 opposing the ground part 222. Two sides of the element part 221, between which the power feeding point P0 is positioned, are each tilted by an angle $\theta$. The angle $\theta$ is a predetermined angle of, for example, substantially 63 degrees.

The ground part 222 has a substantially rectangular shape, and is spaced apart from the element part 221 with a predetermined interval, so as to be insulated.

The connector 213 can be realized by a compact coaxial connector called a UFL connector, and is arranged at the power feeding point P0 of the element part 221. A signal line 231 is soldered to the element part 221, and a sealed part 232 is soldered to the ground part 222. A coaxial cable 214 is to be connected to the connector 213.

Similar to the first embodiment, the dielectric 212 is made of a dielectric material of relatively high dielectric constant $\in r$ such as ABS or MC nylon. The dielectric 212 is formed on the element part 221 of the antenna part 211, so as to be thicker in a direction indicated by an arrow Z1.

According to the second embodiment, similar to the first embodiment, by laminating the dielectric 212 so as to be thicker in a direction of the intended antenna directivity than in another direction, it is possible to make the antenna directivity be in the direction corresponding to the thick part of the dielectric 212. Therefore, directivity can be given to a nondirectional antenna.

Further, the antenna device 200 according to the second embodiment is formed by punching a metal sheet, and resin-molding the punched metal sheet. Therefore, the antenna device 200 can be manufactured at low cost.

A method of manufacturing the antenna device 200 is described.

FIGS. 7A through 7E, 8A, 8B are diagrams for describing the manufacturing method of the antenna device 200.

Figure 7A:
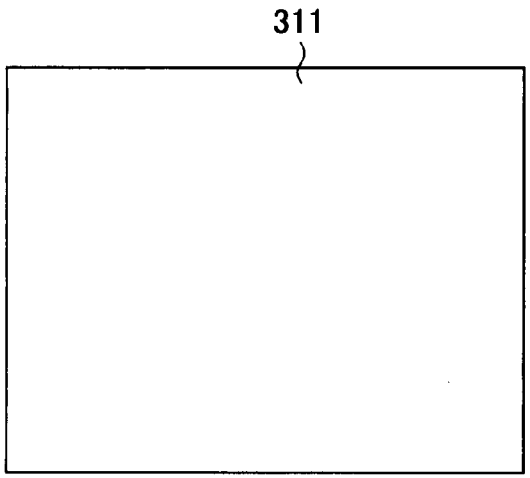
FIGS. 7A through 7E are diagrams for describing a manufacturing method of the antenna device.
Figure 7B:
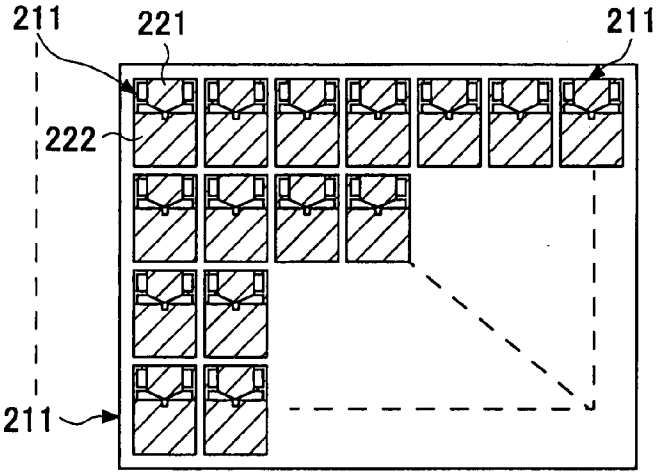
Figure 7C:
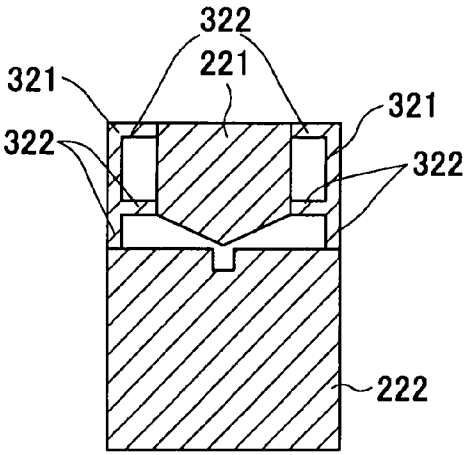

A planar metal sheet 311 shown in FIG. 7A is punched by using a punch die. Accordingly, as shown in FIG. 7B, multiple antenna parts 211 are formed, each including the element part 221 and the ground part 222. The antenna parts 211 shown in FIG. 7B are separated into individual units as shown in FIG. 7C. As shown in FIG. 7C, positions of the element part 221 and the ground part 222 are determined by a frame part 321, so as to be fixed at a predetermined physical relationship. The element part 221 and the ground part 222 are initially connected by the frame part 321. Connection parts 322 between the frame part 321 and the element part 221 and the ground part 222 are in a half-cut status, so that the element part 221 and the ground part 222 can be easily cut off from the frame part 321 later.

Figure 7D:
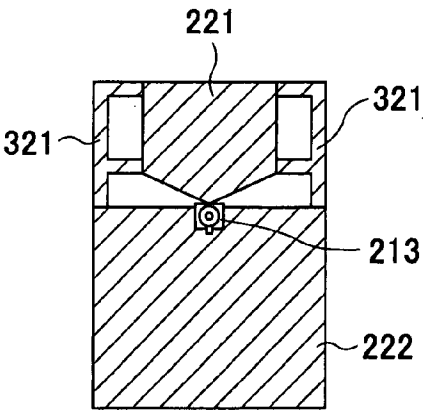

Next, as shown in FIG. 7D, the connector 213 is arranged at a position between the element part 221 and the ground part 222, and soldered thereto. Accordingly, the signal pin 231 of the connector 213 is soldered to the element part 221, and the sealed part 232 of the connector 213 is soldered to the ground part 222. Thus, the element part 221 and the ground part 222 are fixed at predetermined positions via the connector 231.

Figure 7E:
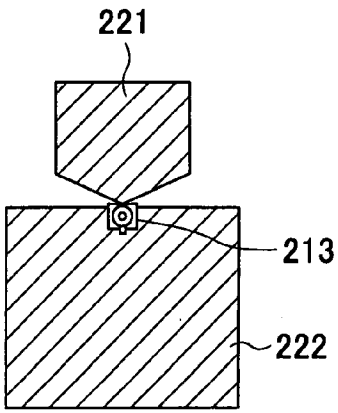

Next, the frame part 321 is cut off from the element part 221 and the ground part 222, thereby manufacturing the antenna part 211 with the connector 213 soldered thereto, as shown in FIG. 7E.

Figure 8A:
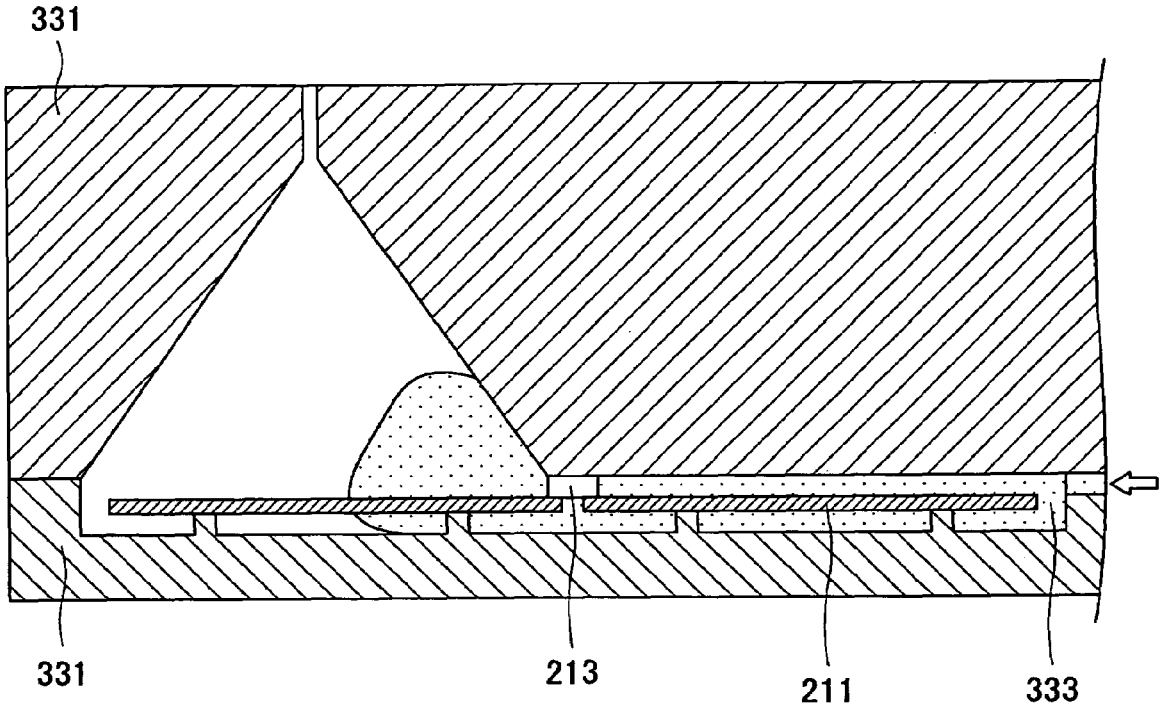
FIGS. 8A, 8B are diagrams for describing the manufacturing method of the antenna device.
Figure 8B:
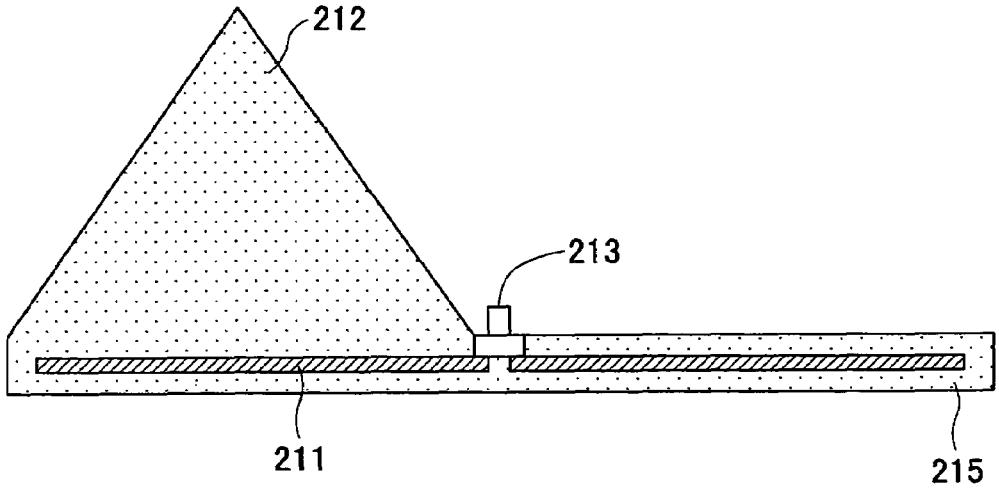

Next, as shown in FIG. 8A, the antenna part 211 to which the connector 213 is soldered is mounted inside a mold die 331. Subsequently, fused, highly dielectric resin 333 is injected to the mold die 331.

By performing resin-molding as shown in FIG. 8A, resin is molded around the element part 221 and the ground part 222 of the antenna part 211, thereby forming the dielectric 212 and an overcoat 215.

Accordingly, the antenna device 200 is manufactured.

In the present embodiment, the connector 213 is mounted; however, a signal line of the coaxial cable 214 can be directly soldered to the element part 221, or a ground line of the coaxial cable 214 can be directly soldered to the ground part 222.

[Variations]

In the above embodiments, the dielectric 112, 212 having a consistent dielectric constant $\in r$ is laminated; however, dielectric materials having different dielectric constants can be sequentially laminated on the element pattern.

Figure 9:
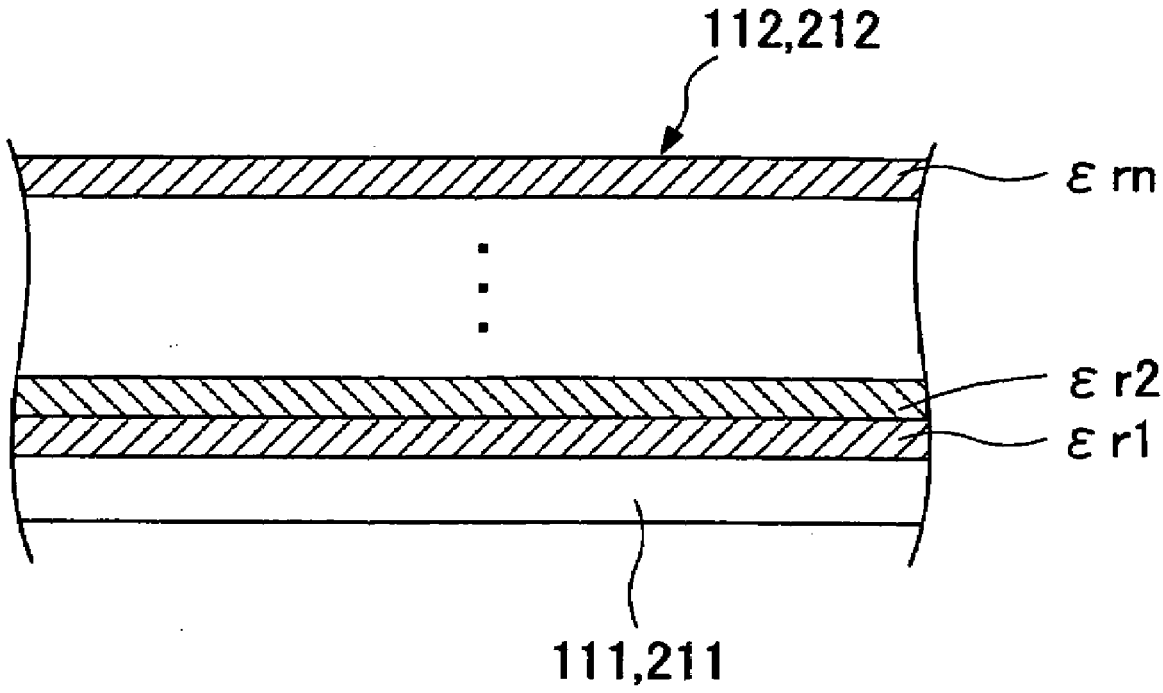
FIG. 9 is a cross-sectional view of a variation of a dielectric.

FIG. 9 is a cross-sectional view of a variation of the dielectric 112, 212.

As shown in FIG. 9, plural layers of the dielectric 112, 212 having different dielectric constants, satisfying $\in r1 < \in r2 \ldots < \in rn$, can be sequentially laminated on the antenna part 111, 211.

Further, in the above embodiments, a monopole type UWB antenna is applied; however, the present invention is not limited thereto. A dipole antenna can be applied. Moreover, the present invention is applicable not only to a UWB antenna, but also to wide band antennas or narrow band antennas.

It is possible to separately form the dielectric 112, 212, and then attach the dielectric 112, 212 to the element pattern of the antenna part 111, 211. The dielectric 112, 212 separately formed can also be insert-molded to the antenna part 111, 211.

The present invention is not limited to the specifically disclosed embodiment, and variations and modifications may be made without departing from the scope of the present invention.

The present application is based on Japanese Priority Patent Application No. 2006-091605, filed on Mar. 29, 2006, the entire contents of which are hereby incorporated by reference.

What is claimed is:

1. An antenna device, comprising:

an antenna part including an element part and a ground part, wherein two sides of the element part are each tilted by a predetermined non-zero angle with respect to an axis orthogonal to a side of the ground part opposing the element part; and a dielectric formed on the element part, wherein the dielectric is formed to be thicker in a direction of directivity that the antenna part is to be made to have, than in another direction.

2. The antenna device according to claim 1, wherein the antenna part includes a printed wiring board, and a conductive pattern formed on the printed wiring board.

3. The antenna device according to claim 1, wherein the antenna part is made of a metal plate.

4. The antenna device according to claim 1, wherein the dielectric is made from highly dielectric resin.

5. The antenna device according to claim 1, wherein the dielectric is formed by insert-molding the antenna part with a dielectric material.

6. The antenna device according to claim 1, wherein the dielectric is formed by laminating plural layers of dielectric material having different dielectric constants.

7. The antenna device according to claim 1, further comprising a power feeding point positioned between the two tilted sides of the element part.

8. The antenna device according to claim 1, further comprising a power feeding point formed on an edge of the element part opposing the ground part.

9. A method of manufacturing an antenna device including an antenna part on which a dielectric material is molded, the antenna part including an element part and a ground part, wherein two sides of the element part are each tilted by a predetermined non-zero angle with respect to an axis orthogonal to a side of the ground part opposing the element part, the method comprising:

insert-molding the antenna part with the dielectric material, such that the dielectric material is thicker in a direction of directivity that the antenna part is to be made to have, than in another direction.

10. A method of manufacturing an antenna device including an antenna part and a dielectric formed on the antenna part, the antenna part including an element part and a ground part, wherein two sides of the element part are each tilted by a predetermined non-zero angle with respect to an axis orthogonal to a side of the ground part opposing the element part, the dielectric being formed to be thicker in a direction of directivity that the antenna part is to be made to have, than in another direction, the method comprising one of:

attaching the dielectric to the antenna part; and insert-molding the antenna part and the dielectric.

* * * * *